US010827809B2

(12) United States Patent
Skahan

(10) Patent No.: US 10,827,809 B2
(45) Date of Patent: Nov. 10, 2020

(54) PROTECTIVE CASE FOR ELECTRONIC DEVICE

(71) Applicant: OTTER PRODUCTS, LLC, Fort Collins, CO (US)

(72) Inventor: Michael S. Skahan, Ramona, CA (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 16/364,469

(22) Filed: Mar. 26, 2019

(65) Prior Publication Data

US 2019/0307217 A1 Oct. 10, 2019

Related U.S. Application Data

(60) Provisional application No. 62/653,005, filed on Apr. 5, 2018.

(51) Int. Cl.
*A45C 11/00* (2006.01)

(52) U.S. Cl.
CPC ..... *A45C 11/00* (2013.01); *A45C 2011/001* (2013.01); *A45C 2011/002* (2013.01); *A45C 2011/003* (2013.01)

(58) Field of Classification Search
CPC ..... A45C 2011/002; A45F 2200/0516; Y10S 224/929
USPC ..... 224/929
See application file for complete search history.

(56) References Cited

U.S. PATENT DOCUMENTS

| | | | |
|---|---|---|---|
| 2,392,787 | A | 1/1946 | Edmond |
| 2,851,670 | A | 9/1958 | Robert |
| 3,023,885 | A | 3/1962 | Kindseth |
| 3,143,384 | A | 8/1964 | Robert |
| 3,482,895 | A | 12/1969 | Becklin |
| 3,665,991 | A | 5/1972 | Gillemot et al. |
| 3,689,866 | A | 9/1972 | Kelly |
| 3,832,725 | A | 8/1974 | Cook |
| 3,922,477 | A | 11/1975 | Glowacz |

(Continued)

FOREIGN PATENT DOCUMENTS

| | | |
|---|---|---|
| AU | 2012271660 | 12/2012 |
| DE | 29612454 U1 | 9/1996 |

(Continued)

OTHER PUBLICATIONS

BodyGloveMobile—Apple iPhone 4 & 4S Zero 360 Case-Clear-Flat Back (no clip) [Retrieved from http://bodyglovemobile.com/product/apple-iphone-4-amp-4s-zero-360deg-case- -clear-flat- back-no-clip,338,63.htm. Dated Apr. 9, 2012].

(Continued)

*Primary Examiner* — Scott T McNurlen

(57) ABSTRACT

A protective case for an electronic device is provided. The protective case includes a first portion configured to receive a bottom portion of the electronic device and a second portion attached to the first portion and configured to receive a top portion of the electronic device. The second portion includes a primary portion and a secondary portion. The primary portion is movable relative to the secondary portion between a closed configuration and an open configuration. The open configuration includes an opening formed between the primary portion and the secondary portion for receiving the electronic device in the protective case.

13 Claims, 8 Drawing Sheets

(56) References Cited

U.S. PATENT DOCUMENTS 4,097,878 A 6/1978 Cramer
4,298,204 A 11/1981 Jinkins
4,312,580 A 1/1982 Schwomma et al.
4,375,323 A 3/1983 Inagaki et al.
4,383,743 A 5/1983 Nozawa et al.
4,418,830 A 12/1983 Dzung et al.
4,420,078 A 12/1983 Belt et al.
4,546,874 A 10/1985 Kirchhan
4,584,718 A 4/1986 Fuller
4,649,453 A 3/1987 Iwasawa
4,658,956 A 4/1987 Takeda et al.
4,686,332 A 8/1987 Greanias et al.
4,703,161 A 10/1987 McLean
4,712,657 A 12/1987 Myers et al.
4,733,776 A 3/1988 Ward
4,762,227 A 8/1988 Patterson
4,803,504 A 2/1989 Maeno et al.
4,836,256 A 6/1989 Meliconi
4,942,514 A 7/1990 Miyagaki et al.
4,963,902 A 10/1990 Fukahori
4,977,483 A 12/1990 Perretta
4,994,829 A 2/1991 Tsukamoto
5,002,184 A 3/1991 Lloyd
D316,932 S 5/1991 Escher
5,025,921 A 6/1991 Gasparaitis et al.
D322,165 S 12/1991 Lloyd
5,087,934 A 2/1992 Johnson
5,092,458 A 3/1992 Yokoyama
5,092,459 A 3/1992 Uljanic et al.
5,175,873 A 12/1992 Goldenberg et al.
5,177,515 A 1/1993 Tsukamoto
5,219,067 A 6/1993 Lima et al.
5,231,381 A 7/1993 Duwaer
5,233,502 A 8/1993 Beatty et al.
5,239,323 A 8/1993 Johnson
5,239,324 A 8/1993 Ohmura et al.
5,285,894 A 2/1994 Kamata et al.
5,294,988 A 3/1994 Wakabayashi et al.
5,305,032 A 4/1994 Arai
5,336,896 A 8/1994 Katz
5,360,108 A 11/1994 Alagia
5,368,159 A 11/1994 Doria
5,380,968 A 1/1995 Morse
5,383,091 A 1/1995 Snell
5,386,084 A 1/1995 Risko
5,388,691 A 2/1995 White
5,388,692 A 2/1995 Withrow et al.
D365,927 S 1/1996 Cho
5,505,328 A 4/1996 Stribiak
5,508,479 A 4/1996 Schooley
5,518,802 A 5/1996 Colvin et al.
5,541,813 A 7/1996 Satoh et al.
RE35,318 E 8/1996 Warman
5,548,306 A 8/1996 Yates et al.
5,583,742 A 12/1996 Noda et al.
5,584,054 A 12/1996 Tyneski et al.
5,586,002 A 12/1996 Notarianni
5,590,760 A 1/1997 Astarb
5,610,655 A 3/1997 Wakabayashi et al.
5,613,237 A 3/1997 Bent et al.
D378,634 S 4/1997 LaPere
5,636,101 A 6/1997 Bonsall et al.
5,660,566 A 8/1997 Ohsumi
5,669,004 A 9/1997 Sellers
5,681,122 A 10/1997 Burke
5,707,757 A 1/1998 Lee
5,713,048 A 1/1998 Hayakawa
5,713,466 A 2/1998 Tajima
5,845,803 A 12/1998 Saito et al.
5,850,915 A 12/1998 Tajima
5,907,721 A 5/1999 Schelling et al.
5,946,501 A 8/1999 Hayakawa
5,950,816 A 9/1999 Reid
5,956,291 A 9/1999 Nehemiah et al.
5,982,520 A 11/1999 Weiser et al.
5,984,157 A * 11/1999 Swetish ..... A45F 3/10 224/631
5,990,874 A 11/1999 Tsumura et al.
5,996,790 A * 12/1999 Yamada ..... G03B 17/08 206/316.1
D419,297 S 1/2000 Richardson et al.
D419,768 S 2/2000 Richardson et al.
6,031,524 A 2/2000 Kunert
6,041,924 A 3/2000 Tajima
D424,035 S 5/2000 Steiner et al.
6,068,119 A 5/2000 Derr et al.
6,092,707 A 7/2000 Bowes
6,094,785 A 8/2000 Montgomery et al.
6,128,441 A 10/2000 Kamata et al.
6,132,367 A 10/2000 Adair
6,201,867 B1 3/2001 Koike
D447,634 S 9/2001 Snider
6,304,459 B1 10/2001 Toyosato et al.
6,311,017 B1 10/2001 Mori
6,313,982 B1 11/2001 Hino
6,317,313 B1 11/2001 Mosgrove et al.
6,349,824 B1 2/2002 Yamada
6,388,877 B1 5/2002 Canova et al.
6,396,769 B1 5/2002 Polany
6,398,585 B1 6/2002 Fukuda
6,415,138 B2 7/2002 Sirola et al.
6,445,577 B1 9/2002 Madsen et al.
6,447,140 B1 9/2002 Lu
6,456,487 B1 9/2002 Hetterick
D464,196 S 10/2002 Parker
6,471,056 B1 10/2002 Tzeng
6,519,141 B2 2/2003 Tseng et al.
6,525,928 B1 2/2003 Madsen et al.
6,532,152 B1 3/2003 White et al.
6,536,589 B2 3/2003 Chang
6,571,056 B2 5/2003 Shimamura et al.
6,574,434 B2 6/2003 Matsuoto et al.
6,594,472 B1 7/2003 Curtis et al.
6,595,608 B1 7/2003 Minelli et al.
6,597,865 B1 7/2003 Negishi et al.
6,614,423 B1 9/2003 Wong et al.
6,614,722 B2 9/2003 Polany et al.
6,616,111 B1 9/2003 White
6,617,973 B1 9/2003 Osterman
6,625,394 B2 9/2003 Smith et al.
6,634,494 B1 10/2003 Derr et al.
6,636,697 B2 10/2003 Smith et al.
6,646,864 B2 11/2003 Richardson
6,659,274 B2 12/2003 Enners
6,665,174 B1 12/2003 Derr et al.
6,667,738 B2 12/2003 Murphy
6,669,017 B2 12/2003 Linihan
6,698,608 B2 3/2004 Parker et al.
6,721,651 B1 4/2004 Minelli
6,751,552 B1 6/2004 Minelli
6,760,570 B1 7/2004 Higdon
6,778,388 B1 8/2004 Minelli
6,785,566 B1 * 8/2004 Irizarry ..... H04B 1/3888 455/575.1
6,819,866 B2 11/2004 Silva
6,822,161 B2 11/2004 Komatsu et al.
6,822,640 B2 11/2004 Derocher
6,844,845 B1 1/2005 Whiteside et al.
6,848,930 B2 2/2005 Fukuda
6,913,201 B1 7/2005 Wagner et al.
6,914,774 B1 7/2005 Albertini et al.
D507,871 S 8/2005 DiMarchi et al.
6,953,126 B2 10/2005 Parker et al.
6,954,405 B2 10/2005 Polany et al.
6,955,293 B1 10/2005 Katsanevas
6,971,517 B2 12/2005 Chen
6,975,888 B2 12/2005 Buesseler et al.
6,980,777 B2 12/2005 Shepherd et al.
6,983,130 B2 1/2006 Chien et al.
6,987,527 B2 1/2006 Kossin
6,992,659 B2 1/2006 Gettemy
6,995,976 B2 2/2006 Richardson
D516,807 S 3/2006 Richardson et al.
7,025,274 B2 4/2006 Solomon et al.

(56) References Cited

U.S. PATENT DOCUMENTS 7,033,215 B2 4/2006 Kobayashi
7,046,230 B2 5/2006 Zadesky et al.
7,050,712 B2 5/2006 Shimamura
7,050,841 B1 5/2006 Onda
7,054,441 B2 5/2006 Pletikosa
7,061,762 B2 6/2006 Canova et al.
7,069,063 B2 6/2006 Halkosaari et al.
7,072,467 B2 7/2006 Ono
7,082,264 B2 7/2006 Watanabe et al.
7,085,542 B2 8/2006 Dietrich et al.
7,106,959 B2 9/2006 Sato
D530,079 S 10/2006 Thomas et al.
7,146,701 B2 12/2006 Mahoney et al.
7,158,376 B2 1/2007 Richardson et al.
7,180,735 B2 2/2007 Thomas et al.
7,194,086 B2 3/2007 Pletikosa
7,194,202 B2 3/2007 Funahashi et al.
7,194,291 B2 3/2007 Peng
D542,524 S 5/2007 Richardson et al.
7,230,823 B2 6/2007 Richardson et al.
7,236,588 B2 6/2007 Gartrell
7,255,228 B2 8/2007 Kim
7,263,032 B2 8/2007 Polany et al.
7,312,984 B2 12/2007 Richardson et al.
7,327,841 B2 2/2008 Schreiber et al.
7,341,144 B2 3/2008 Tajiri et al.
7,343,184 B2 3/2008 Rostami
7,352,961 B2 4/2008 Watanabe et al.
7,362,570 B2 4/2008 Su
7,365,281 B2 4/2008 Yamaguchi et al.
7,366,555 B2 4/2008 Jokinen et al.
7,369,881 B2 5/2008 Tsujimoto
7,389,869 B2 6/2008 Mason
7,400,917 B2 7/2008 Wood et al.
D574,819 S 8/2008 Andre et al.
D575,056 S 8/2008 Tan
7,409,148 B2 8/2008 Takahashi et al.
7,418,278 B2 8/2008 Eriksson et al.
7,428,427 B2 9/2008 Brunstrom et al.
7,436,653 B2 10/2008 Yang et al.
D581,421 S 11/2008 Richardson et al.
7,448,908 B2 11/2008 Iwahori et al.
D582,149 S 12/2008 Tan
7,464,813 B2 12/2008 Carnevali
7,464,814 B2 12/2008 Carnevali
7,495,659 B2 2/2009 Marriott et al.
7,495,895 B2 2/2009 Carnevali
7,499,040 B2 3/2009 Zadesky et al.
7,502,550 B2 3/2009 Ariga
7,511,956 B2 3/2009 Tomioka et al.
7,525,792 B2 4/2009 Yokote
7,535,799 B2 5/2009 Polany et al.
D593,319 S 6/2009 Richardson et al.
7,555,325 B2 6/2009 Goros
D597,089 S 7/2009 Khan et al.
7,558,594 B2 7/2009 Wilson
7,594,576 B2 9/2009 Chen et al.
7,609,512 B2 10/2009 Richardson et al.
D603,603 S 11/2009 Laine et al.
7,613,386 B2 11/2009 Shimamura
7,623,898 B2 11/2009 Holmberg
D605,850 S 12/2009 Richardson et al.
D606,751 S 12/2009 Andre et al.
7,630,746 B2 12/2009 Holmberg
7,653,292 B2 1/2010 Yamaguchi et al.
7,663,878 B2 2/2010 Swan et al.
7,663,879 B2 2/2010 Richardson et al.
D611,478 S 3/2010 Richardson et al.
7,679,674 B2 3/2010 Nishizawa
7,688,580 B2 3/2010 Richardson et al.
7,697,269 B2 4/2010 Yang et al.
D616,430 S 5/2010 Fathollahi
7,733,642 B2 6/2010 Liou et al.
7,755,975 B2 7/2010 Pettersen et al.
D622,716 S 8/2010 Andre et al.
7,772,507 B2 8/2010 Orr et al.
7,775,354 B2 8/2010 Latchford et al.
7,782,610 B2 8/2010 Diebel et al.
7,787,756 B2 8/2010 Funahashi et al.
D623,180 S 9/2010 Diebel
D624,532 S 9/2010 Huskinson
7,789,228 B2 9/2010 Zenzai
7,789,696 B2 9/2010 Umei et al.
7,801,425 B2 9/2010 Fantone et al.
D624,908 S 10/2010 Huskinson
D624,909 S 10/2010 Huskinson
7,850,032 B2 12/2010 Carnevali et al.
7,854,434 B2 12/2010 Heiman et al.
7,889,489 B2 2/2011 Richardson et al.
7,907,394 B2 3/2011 Richardson et al.
7,926,818 B2 4/2011 Isono
7,933,122 B2 4/2011 Richardson et al.
7,936,566 B2 5/2011 Shigyo et al.
7,941,196 B2 5/2011 Kawasaki et al.
7,944,697 B2 5/2011 Hata et al.
7,975,870 B2 7/2011 Laule et al.
7,978,092 B2 7/2011 Osaka
7,993,071 B2 8/2011 Clawson
8,004,835 B2 8/2011 Conti et al.
8,006,020 B2 8/2011 Minoo
D644,636 S 9/2011 Richardson et al.
8,024,015 B2 9/2011 Araki et al.
8,031,472 B2 10/2011 Bicket et al.
8,032,194 B2 10/2011 Liu et al.
8,053,668 B2 11/2011 Lai et al.
8,068,331 B2 11/2011 Sauers et al.
8,089,757 B2 1/2012 Chen et al.
8,101,859 B2 1/2012 Zadesky
8,112,130 B2 2/2012 Mittleman et al.
8,138,434 B2 3/2012 Tang et al.
8,160,657 B2 4/2012 Perriello et al.
8,164,899 B2 4/2012 Yamaguchi et al.
8,167,126 B2 5/2012 Stiehl
8,191,706 B1 6/2012 Liu
8,204,561 B2 6/2012 Mongan et al.
8,223,997 B2 7/2012 Ron et al.
8,245,842 B2 8/2012 Bau
8,251,210 B2 8/2012 Schmidt et al.
8,265,264 B2 9/2012 Yamaguchi et al.
8,269,104 B2 9/2012 Choraku et al.
8,286,789 B2 10/2012 Wilson et al.
8,295,043 B2 10/2012 Tai et al.
8,311,595 B2 11/2012 Takatsuka et al.
8,342,325 B2 1/2013 Rayner
8,373,980 B2 2/2013 Reber
8,393,466 B2 3/2013 Rayner
8,428,664 B1 * 4/2013 Wyers ..... F16M 13/04 455/575.1
8,430,240 B2 4/2013 Kim
8,454,101 B2 6/2013 Kuo
8,483,786 B2 * 7/2013 Ramies ..... B67B 7/16 455/575.8
8,520,373 B2 8/2013 Liu
8,526,180 B2 9/2013 Rayner
8,531,824 B2 9/2013 Rayner
8,531,834 B2 9/2013 Rayner
8,548,541 B2 10/2013 Rayner
8,564,950 B2 10/2013 Rayner
8,570,737 B2 10/2013 Rayner
8,584,847 B2 11/2013 Tages et al.
8,599,547 B2 12/2013 Richardson et al.
8,681,103 B2 3/2014 Cha et al.
8,708,142 B2 4/2014 Rayner
8,798,675 B2 8/2014 Salmon et al.
8,833,379 B1 9/2014 Kaplan
8,995,126 B2 3/2015 Rayner
9,276,626 B2 3/2016 Rayner
9,549,598 B2 * 1/2017 Rayner ..... A45C 13/008
10,090,877 B2 10/2018 Rayner et al.
2001/0040109 A1 11/2001 Yaski et al.
2002/0003584 A1 1/2002 Kossin
2002/0009195 A1 1/2002 Schon
2002/0065054 A1 5/2002 Humphreys et al.
2002/0071550 A1 6/2002 Pletikosa

(56) References Cited

U.S. PATENT DOCUMENTS

2002/0079244 A1 6/2002 Kwong
2002/0085709 A1 7/2002 Hsu
2002/0090212 A1 7/2002 Shimamura et al.
2002/0092742 A1 7/2002 Rohmer et al.
2002/0122353 A1 9/2002 Polany et al.
2002/0136557 A1 9/2002 Shimamura
2002/0137475 A1 9/2002 Shou et al.
2002/0175096 A1 11/2002 Linihan
2002/0175901 A1 11/2002 Gettemy
2002/0193136 A1 12/2002 Halkosaari et al.
2002/0195910 A1 12/2002 Hus et al.
2003/0080947 A1 5/2003 Genest et al.
2003/0095374 A1 5/2003 Richardson
2003/0111366 A1 6/2003 Enners
2003/0118332 A1 6/2003 Smith et al.
2003/0118334 A1 6/2003 Smith et al.
2003/0128397 A1 7/2003 Smith et al.
2003/0223577 A1 12/2003 Ono
2004/0014506 A1 1/2004 Kemppinen
2004/0076415 A1 4/2004 Silva
2004/0089570 A1 5/2004 Chien et al.
2004/0120219 A1 6/2004 Polany et al.
2004/0121226 A1 6/2004 Kaelin et al.
2004/0188120 A1 9/2004 Komatsu et al.
2004/0195783 A1 10/2004 Akagi et al.
2004/0203502 A1 10/2004 Dietrich et al.
2004/0226836 A1 11/2004 Schreiber et al.
2005/0052425 A1 3/2005 Zadesky et al.
2005/0094024 A1 5/2005 Sato
2005/0110768 A1 5/2005 Marriott et al.
2005/0115852 A1 6/2005 Funahashi et al.
2005/0123161 A1 6/2005 Polany et al.
2005/0139498 A1 6/2005 Goros
2005/0167304 A1 8/2005 Shimamura
2005/0174727 A1 8/2005 Thomas et al.
2005/0181843 A1 8/2005 Tsujimoto
2005/0224508 A1 10/2005 Tajiri et al.
2005/0247584 A1 11/2005 Lu
2005/0279655 A1 12/2005 Chen
2005/0279661 A1 12/2005 Hodges
2006/0003709 A1 1/2006 Wood
2006/0008261 A1 1/2006 Watanabe et al.
2006/0110146 A1 5/2006 Ariga
2006/0113173 A1 6/2006 Matsumoto et al.
2006/0169608 A1 8/2006 Carnevali
2006/0255493 A1 11/2006 Fouladpour
2006/0274493 A1 12/2006 Richardson et al.
2007/0040931 A1 2/2007 Nishizawa
2007/0071423 A1 3/2007 Fantone et al.
2007/0074473 A1 4/2007 Yamaguchi et al.
2007/0086273 A1 4/2007 Polany et al.
2007/0109730 A1 5/2007 Shigyo et al.
2007/0110416 A1 5/2007 Yamaguchi et al.
2007/0115387 A1 5/2007 Ho
2007/0138920 A1 6/2007 Austin et al.
2007/0139873 A1 6/2007 Thomas et al.
2007/0146985 A1 6/2007 Mick et al.
2007/0158220 A1 7/2007 Cleereman et al.
2007/0171603 A1 7/2007 Yang et al.
2007/0184781 A1 8/2007 Huskinson
2007/0215663 A1 9/2007 Chongson et al.
2007/0241012 A1 10/2007 Latchford et al.
2007/0261976 A1 11/2007 Anderson
2007/0261978 A1 11/2007 Sanderson
2007/0280053 A1 12/2007 Polany et al.
2007/0297149 A1 12/2007 Richardson et al.
2008/0055258 A1 3/2008 Sauers
2008/0081679 A1 4/2008 Kawasaki et al.
2008/0157485 A1 7/2008 Isono
2008/0164267 A1 7/2008 Huber
2009/0005136 A1 1/2009 Hutzel et al.
2009/0009945 A1 1/2009 Johnson et al.
2009/0017884 A1 1/2009 Rotschild
2009/0028535 A1 1/2009 Funahashi et al.
2009/0032420 A1 2/2009 Zenzai
2009/0080153 A1 3/2009 Richardson et al.
2009/0087655 A1 4/2009 Yamada et al.
2009/0090532 A1 4/2009 Lai et al.
2009/0109635 A1 4/2009 Chen et al.
2009/0117957 A1 5/2009 Araki et al.
2009/0167545 A1 7/2009 Osaka
2009/0175020 A1 7/2009 Zadesky
2009/0211775 A1 8/2009 Yamaguchi et al.
2009/0215412 A1 8/2009 Liu et al.
2009/0260844 A1 10/2009 Tseng
2010/0006314 A1 1/2010 Ron et al.
2010/0020393 A1 1/2010 Mazzio
2010/0044198 A1 2/2010 Tang et al.
2010/0053355 A1 3/2010 Iwase et al.
2010/0085691 A1 4/2010 Yeh et al.
2010/0093412 A1 4/2010 Serra et al.
2010/0104814 A1 4/2010 Richardson et al.
2010/0144194 A1 6/2010 Umei et al.
2010/0147737 A1 6/2010 Richardson et al.
2010/0181108 A1 7/2010 Hata et al.
2010/0200456 A1 8/2010 Parkinson
2010/0203931 A1 8/2010 Hynecek et al.
2010/0206601 A1 8/2010 Choraku et al.
2010/0238119 A1 9/2010 Dubrovsky et al.
2010/0251827 A1 10/2010 Bourbeau et al.
2010/0311475 A1 12/2010 Takatsuka et al.
2010/0313485 A1 12/2010 Kuo
2011/0002106 A1 1/2011 Bentley et al.
2011/0017620 A1 1/2011 Latchford et al.
2011/0024315 A1 2/2011 Kim
2011/0073608 A1 3/2011 Richardson et al.
2011/0157055 A1 6/2011 Tilley et al.
2011/0157800 A1 6/2011 Richardson et al.
2011/0228460 A1 9/2011 Kim et al.
2011/0300731 A1 12/2011 Nakamura
2012/0018325 A1 1/2012 Kim
2012/0019920 A1 1/2012 Mongan et al.
2012/0031914 A1 2/2012 Liu
2012/0043235 A1 2/2012 Klement
2012/0067711 A1 3/2012 Yang
2012/0099261 A1 4/2012 Reber
2012/0099262 A1 4/2012 Reber et al.
2012/0099265 A1 4/2012 Reber
2012/0099266 A1 4/2012 Reber et al.
2012/0100737 A1 4/2012 Frey
2012/0103844 A1 5/2012 Piedra et al.
2012/0118773 A1 5/2012 Rayner
2012/0168336 A1 7/2012 Schmidt et al.
2012/0180852 A1 7/2012 Cheng et al.
2012/0261289 A1 10/2012 Wyner et al.
2012/0305422 A1 12/2012 Vandiver
2012/0314354 A1 12/2012 Rayner
2013/0027862 A1 1/2013 Rayner
2013/0043777 A1 2/2013 Rayner
2013/0077226 A1 3/2013 Rayner
2013/0084728 A1 4/2013 Omae et al.
2013/0088130 A1 4/2013 Rayner
2013/0088813 A1 4/2013 Su et al.
2013/0088828 A1 4/2013 Rayner
2013/0092576 A1 4/2013 Rayner
2013/0098788 A1 4/2013 McCarville et al.
2013/0156218 A1 6/2013 Annacone et al.
2013/0188312 A1 7/2013 Rayner
2013/0220841 A1 8/2013 Yang
2013/0242481 A1 9/2013 Kim et al.
2013/0334072 A1 12/2013 Rayner
2014/0038443 A1 2/2014 Campbell et al.
2014/0065847 A1 3/2014 Salmon et al.
2014/0099526 A1 4/2014 Powell et al.
2014/0152890 A1 6/2014 Rayner
2014/0187289 A1 7/2014 Cataldo et al.
2014/0213088 A1 7/2014 Furuya et al.
2014/0228074 A1 8/2014 Kulkarni et al.
2014/0248787 A1 9/2014 Suzuki et al.
2014/0262848 A1 9/2014 Fathollahi et al.
2014/0339012 A1 11/2014 Richardson et al.
2015/0102073 A1* 4/2015 Pusateri ..... H04B 1/3888
224/191

(56) References Cited

U.S. PATENT DOCUMENTS

| | | | | |
|---|---|---|---|---|
| 2015/0172798 | A1 | 6/2015 | Chao | |
| 2015/0194994 | A1* | 7/2015 | Soriano | H04B 1/3888 455/575.8 |
| 2015/0257285 | A1 | 9/2015 | Wilson et al. | |

FOREIGN PATENT DOCUMENTS

| | | | |
|---|---|---|---|
| EP | 1018680 | A2 | 7/2000 |
| EP | 1939263 | A1 | 7/2008 |
| EP | 2129202 | A2 | 12/2009 |
| EP | 2180773 | A1 | 4/2010 |
| GB | 2482877 | | 2/2012 |
| JP | H0561069 | U | 8/1993 |
| JP | H0818637 | A | 6/1994 |
| JP | 3060175 | U | 7/1999 |
| JP | 3066786 | U | 3/2000 |
| JP | 2000125916 | A | 5/2000 |
| JP | 2000341383 | A | 12/2000 |
| JP | 2001046132 | A | 2/2001 |
| JP | 2001061530 | A | 3/2001 |
| JP | 2002280757 | A | 9/2002 |
| JP | 2003164316 | A | 6/2003 |
| JP | 3458295 | B2 | 10/2003 |
| JP | 2003304161 | A | 10/2003 |
| JP | 2004070657 | | 3/2004 |
| JP | 2005129807 | A | 5/2005 |
| WO | 1994000037 | A1 | 1/1994 |
| WO | 1999041958 | A1 | 8/1999 |
| WO | 2000051315 | A1 | 8/2000 |
| WO | 2002011161 | A2 | 2/2002 |
| WO | 2011039723 | A1 | 4/2011 |
| WO | 2012074151 | A1 | 6/2012 |
| WO | 2012051358 | | 12/2012 |
| WO | 2012174175 | A2 | 12/2012 |
| WO | 2013096927 | A1 | 6/2013 |

OTHER PUBLICATIONS

Casemate Chrome with Mirror Screen Protector for iPhone 4/4S Case-Mate [Retrieved from http://www.case-mate.com/iPhone-4-Cases/Case-Mate-iPhone-4-4S-Chrome-with- -Mirror- Screen-Protector.asp. Dated Apr. 9, 2012].

Drafahl, Jack; Drafahl, Sue, A Supremely Compact Video Housing, Ikelite's Sony TR-5, Skin Diver Magazine New Product Series, Nov. 1990.

Drafahl, Jack; Drafahl, Sue, Aqua Video Housing for the Sony CCD-V99, Skin Diver Magazine, Dec. 1989.

Drafahl, Jack; Drafahl, Sue, Hypertech Pro-40 An U/W video housing that is tough as nails, Skin Diver Magazine, Jun. 1989.

Drafahl, Jack; Drafahl, Sue, Hypertech's Pro-9A Housing Tough as a Tank in Battle, Skin Diver Magazine, Apr. 1989.

Drafahl, Jack; Drafahl, Sue, Ikelite Video Housing for the Sony CCD-V9 Diving's First Hybrid Video Case, Skin Diver Magazine, May 1989.

Drafahl, Jack; Drafahl, Sue, Ikelite's CCD-V101 A Sony Housing That Allows Access to 25 Camera Functions, Skin Diver Magazine, Jun. 1991.

Drafahl, Jack; Drafahl, Sue, Ikelite's JVC GR-A1U Housing, Full Range Auto Focus Video from Macro to Infinity, Skin Diver Magazine, Jun. 1990.

Drafahl, Jack; Drafahl, Sue, Sea & Sea VX-1000 Digital Video Goes Underwater, Skin Diver Magazine, Mar. 1998.

Drafahl, Jack; Drafahl, Sue, Sea & Sea's CX-600, Skin Diver Magazine, Dec. 1997.

Drafahl, Jack; Drafahl, Sue, The Delux PRO-PAK6, Equinox's Answer to the Ideal Video Housing, Skin Diver Magazine, Oct. 1989.

Eaglecell, Inc.—Eaglecell Phone Accessories—iPhone 4(AT&T/Verizon)/ 4S(AT&T/Verizon/Sprint) [Retrieved from http://www.eaglecell.com/Ecommerce/general/BrowsrCategory.aspx?C . . . Dated Apr. 9, 2012].

Gadgetmac—CaseMate Phantom Case for iPhone 4/S Review [Retrieved from http://www.gadgetmac.com/reviews/case-mate-phantom-case-for-iphon . . . Dated Apr. 9, 2012].

Griffin cases & covers for iPhone 4 and iPhone 4s [Retrieved from http://www.griffintechnology.com/iphone/cases. Dated Apr. 9, 2012].

Hard Candy Cases—Bubble 360 Case for the new iPAD [Retrieved from http://www.hardcandycases.com/bubble-360-case-for-new-ipad.html. Dated Apr. 9, 2012].

OtterBox Commuter Series Cases OtterBox.com [Retrieved from http://www.otterbox.com/commuter-series,default,pg.html. Dated Apr. 9, 2012].

Sony Corporation, MPK-F40/F340 Service Manual Handycam Marine Pack Sony, Published by an Engineering Service Department, 1988.

Sony Corporation, MPK-TR, Operating Instructions, Handycam Marine Pack, Downloaded from www.Manualslib.com manuals search engine, 1990.

TakTik—iPhone Case [Retrieved from http://articlesdownload.com/2012/08/16taktik-premiumprotection-system . . . Dated Apr. 9, 2012].

* cited by examiner

PROTECTIVE CASE FOR ELECTRONIC DEVICE

CROSS-REFERENCE TO RELATED APPLICATIONS

This application claims priority to U.S. Provisional Application 62/653,005, filed Apr. 5, 2018, and incorporated herein by reference in its entirety.

BACKGROUND

Personal electronic devices are commonly used for communication, entertainment purposes, as well as Internet access and a variety of other purposes. Examples of personal electronic devices include smartphones, tablet computers, gaming devices, audio players, video players, cameras, portable computers, two-way radios, GPS receivers, smart glasses, virtual reality glasses or helmets, masks or eyewear including an electronic display, and/or other portable devices.

Protective cases for electronic devices provide protection for the electronic device from various forms of damage, including damage from dust, water, snow, dirt, and drops. Exemplary protective cases are disclosed in U.S. Pat. Nos. 8,342,325; 9,295,174; 9,300,344; 9,774,713; and 9,807,211, the disclosures of which are hereby incorporated by reference in their entirety.

SUMMARY

In one exemplary embodiment, a protective case for an electronic device is provided. The protective case includes a first portion and a second portion. The first portion is configured to encase a first portion of the electronic device when the electronic device is positioned within the protective case. The second portion configured to encase a second portion of the electronic device when the electronic device is positioned within the protective case. The second portion includes a primary portion and a secondary portion. The secondary portion is flexibly attached to the first portion by a living hinge. The secondary portion is movable between an open configuration and a closed configuration. The second portion is configured to allow the electronic device to be inserted into or removed from the protective case when the secondary portion is in the open configuration. The second portion is configured to form a waterproof seal with the primary portion when the secondary portion is in the closed configuration. In a more particular embodiment, the secondary portion forms about 50% or less of the perimeter of the protective case.

In one exemplary embodiment, a protective case for an electronic device is provided. The protective case includes a rear surface configured to at least partially cover a rear surface of the electronic device when the electronic device is encased in the protective case. The rear surface includes an attachment region comprising a plurality of hooks integrally formed into the rear surface of the protective case. The plurality of hooks are configured to releasably attach to corresponding loops of an accessory module.

In one exemplary embodiment, a protective case for an electronic device is provided. The protective case includes a first portion and a second portion. The first portion is configured to cover at least a portion of a rear of the electronic device when the electronic device is positioned within the protective case. The second portion is configured to cover at least a portion of the front of the electronic device when the electronic device is positioned within the protective case. One of the first portion and the second portion includes one or more grooves and the other of the first portion and the second portion includes one or more projections configured to be inserted into the one or more grooves to allow the second portion to slide relative to the first portion between an open configuration and a closed configuration. The protective case also includes an end member positioned on a distal end of the second portion and formed from a flexible material. The end member configured to be deformed to allow for the installation or removal of the electronic device from the protective case.

In one exemplary embodiment, a membrane for protecting a touch-screen of an electronic device is provided. The membrane has a main portion formed from a transparent polymeric material and having a first thickness. The membrane further has a reduced thickness portion having a second thickness, the second thickness being less than the first thickness. The reduced thickness portion is integrally formed from the transparent polymeric material of the main portion.

In one exemplary embodiment, a protective case for an electronic device is provided. The protective case includes a first portion and a second portion. The first portion is configured to cover at least a portion of a rear of the electronic device when the electronic device is positioned within the protective case. The second portion is configured to cover at least a portion of the front of the electronic device when the electronic device is positioned within the protective case. The second portion includes a plurality of clasping mechanisms configured to selectively engage with a corresponding plurality of clasping mechanisms on the first portion. The protective case further includes a recess formed in at least one of the first portion and the second portion and a case key attached to one of the first portion and the second portion. The case key is movable from a first position in which the case key is at least partially positioned within the recess to a second position in which the case key is configured to release at least some of the plurality of clasping mechanisms of the second portion from the corresponding clasping mechanisms of the first portion. In one more particular embodiment, the case key is configured to rotate relative to the first portion and the second portion between the first position and the second position, and the case key is configured to release at least some of the plurality of clasping mechanisms of the second portion from the corresponding clasping mechanisms of the first portion by twisting the case key relative to the first portion and the second portion. In another more particular embodiment, the case key is configured to rotate and slide relative to the first portion and the second portion between the first position and the second position, and the case key is configured to release at least some of the plurality of clasping mechanisms of the second portion from the corresponding clasping mechanisms of the first portion by inserting a wedge of the case key into a slot of formed between the first portion and the second portion.

In one exemplary embodiment, a protective case for an electronic device is provided. The protective case includes a first portion configured to receive a bottom portion of the electronic device and a second portion attached to the first portion and configured to receive a top portion of the electronic device. The second portion includes a primary portion and a secondary portion. The primary portion is movable relative to the secondary portion between a closed configuration and an open configuration. The open configuration includes an opening formed between the primary portion and the secondary portion for receiving the electronic device in the protective case.

In one exemplary embodiment, a protective case for an electronic device is provided. The protective case includes a first portion configured to at least partially cover a rear surface of the electronic device when the electronic device is received in the protective case and a second portion configured to at least partially cover a front surface of the electronic device when the electronic device is received in the protective case. One of the first portion and the second portion includes one or more grooves and the other of the first portion and the second portion includes one or more projections received within the grooves. The one or more projections are configured to slide within the one or more grooves to allow the first portion to slide relative to the second portion between a closed configuration and an open configuration including an opening formed between the first portion and the second portion for receiving the electronic device in the protective case.

In one exemplary embodiment, a protective case for an electronic device is provided. The protective case includes a first portion configured to cover at least a portion of a rear of the electronic device when the electronic device is received within the protective case and a second portion configured to cover at least a portion of the front of the electronic device when the electronic device is positioned within the protective case. The second portion includes a plurality of clasping mechanisms configured to selectively engage with a corresponding plurality of clasping mechanisms on the first portion. The protective case also includes a recess formed in at least one of the first portion and the second portion and a case key attached to one of the first portion and the second portion. The case key is movable from a first position in which the case key is at least partially positioned within the recess to a second position in which the case key is configured to release at least some of the plurality of clasping mechanisms of the second portion from the corresponding clasping mechanisms of the first portion.

In a further embodiment of any of the above embodiments, a rear surface of the protective case includes a plurality of hooks integrally molded into the rear surface of the protective case, the plurality of hooks configured to releasably attach the protective case to corresponding loops of an accessory module.

In a further embodiment of any of the above embodiments, the protective case includes a screen protector configured to at least partially cover a display of the electronic device when the electronic device is received within the protective case, the screen protector including a reduced thickness area having a thickness less than a thickness of a remainder of the screen protector, the reduced thickness area configured to align with a button or a fingerprint sensor of the electronic device when the electronic device is received within the protective case.

DETAILED DESCRIPTION

Figure 1:
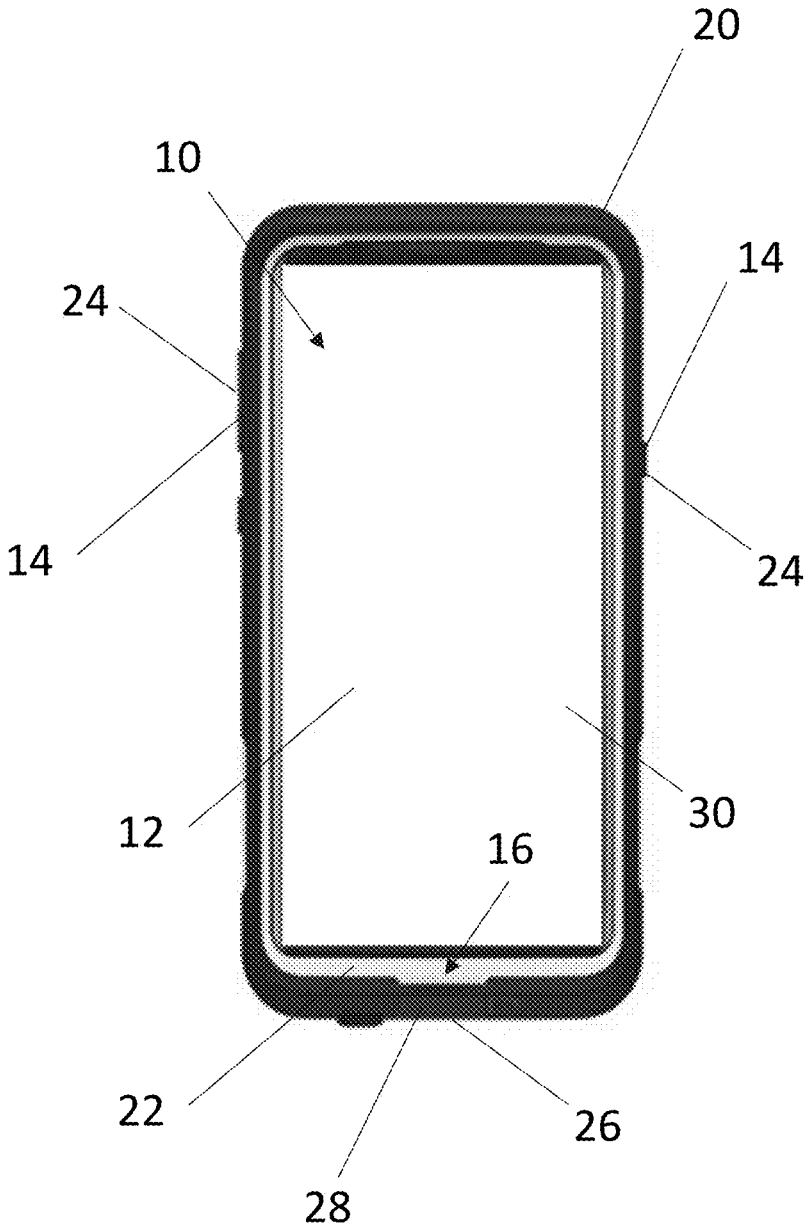
FIG. 1 illustrates an exemplary electronic device received within a protective case.

FIG. 1 illustrates an exemplary electronic device 10 received within a protective case 20. Exemplary electronic devices 10 include smartphones, tablet computers, gaming devices, audio players, video players, fitness devises, medical devices, cameras, portable computers, two-way radios, GPS receivers, and/or other portable devices. Electronic device 10 includes a display 12, such as a touch-screen display. In some embodiments, electronic device 10 includes one or more input devices 14, such as knobs, switches, or buttons, for receiving an input from a user. Electronic device 10 further includes a charge port 16 adapted to receive a cable configured to provide electrical power and/or exchange data with electronic device 10.

Protective case 20 at least partially covers one or more surfaces of electronic device 10. In some embodiments, protective case 20 includes a frame member 22 at least partially surrounding the received electronic device 10. In some embodiments, protective case 20 includes one or more molded buttons 24 positioned to align with one or more of the input devices 14 of the electronic device 10 to allow a user to interact with the input device 14 when the electronic device 10 is received within protective case 20.

In some embodiments, the frame member 22 includes an aperture 26 providing access to the charge port 16 of electronic device 10. In some exemplary embodiments, the aperture 26 may be covered by a charge port cover 28 moveable between the closed position illustrated in FIG. 1 and an open position providing access to the charge port 16 of electronic device 10.

In some embodiments, protective case 20 includes a screen protector 30 configured to cover at least a portion of the display 12 of electronic device 10 when electronic device 10 is received within protective case 20. In some embodiments, at least a portion of screen protector 30 is transparent to allow a user to view display 12 of electronic device 10. In some more particular embodiments, screen protector 30 comprises a glass or fortified glass material. In other more particular embodiments, screen protector 30 comprises a thermoplastic membrane, such as a membrane formed from polyethylene terephthalate (PET), polycarbonate (PC), poly(methyl methacrylate) (PMMA), or other suitable material.

Figure 2A:
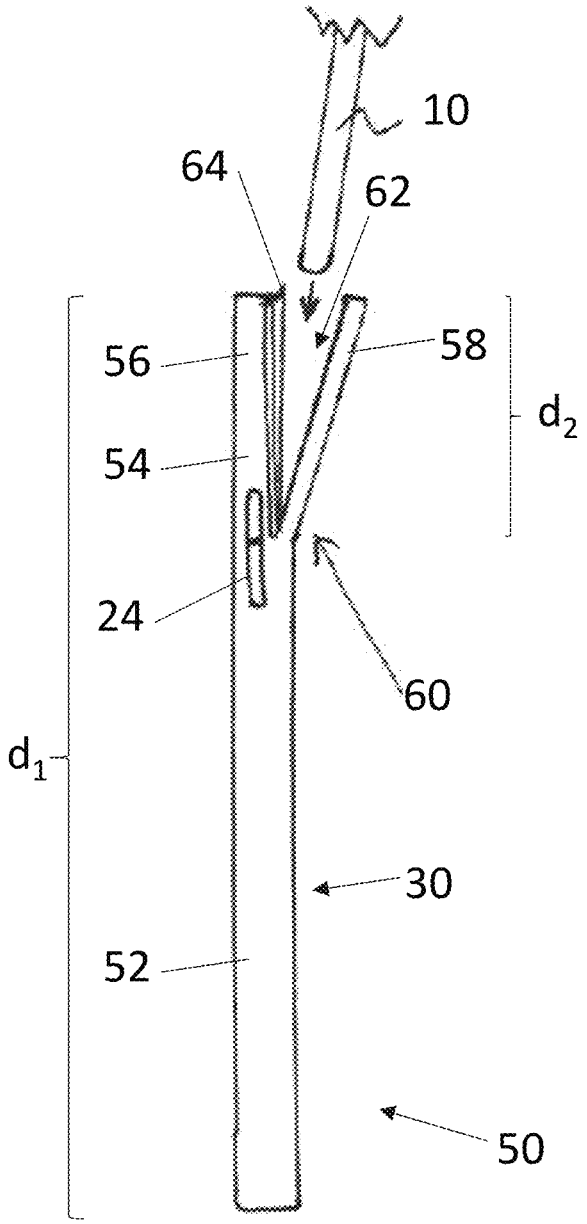
FIG. 2A illustrates inserting an electronic device into an exemplary protective case in an open configuration.
Figure 2B:
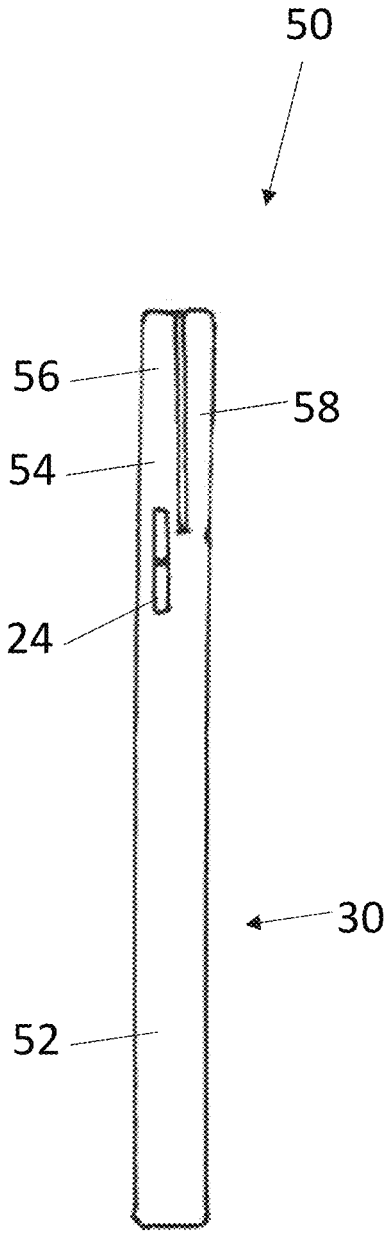
FIG. 2B illustrates the protective case of FIG. 2A in a closed configuration.

Referring next to FIGS. 2A and 2B, a protective case 50 for protecting electronic device 10 is illustrated. In some embodiments, protective case 20 (FIG. 1) is protective case 50.

Protective case 50 includes a first portion 52 and a second portion 54. Although illustrated in FIG. 2A with the first portion 52 as a bottom portion of case 50 and the second portion 54 as a top portion of case 50, in other embodiments first portion 52 comprises a top portion or side portion of case 50 and second portion 54 comprises a bottom portion or side opposing portion of case 50.

First portion 52 illustratively encases at least a portion of electronic device 10 when electronic device 10 is received within case 50, such as at least a portion of the bottom of electronic device 10. In some embodiments, first portion 52 provides a waterproof barrier between the received electronic device 10 and an external environment.

Second portion 54 illustratively encases at least a portion of electronic device 10 when electronic device 10 is received within case 50, such as at least a portion of the top of electronic device 10. Second portion 54 includes a primary portion 56 and secondary portion 58. Primary portion 56 illustratively covers at least a portion of electronic device 10 when electronic device 10 is received within case 50, such as at least a portion of the top back surface of electronic device 10. Secondary portion 58 illustratively covers at least a portion of electronic device 10 when electronic device 10 is received within case 50, such as at least a portion of the top front surface of electronic device 10.

One or more of primary portion 56 and secondary portion 58 is flexibly attached to the first portion 52, such as with a living hinge 60. In the exemplary embodiment illustrated in FIG. 12A, primary portion 56 is rigidly attached to a rear surface of first portion 52 and secondary portion 58 is flexibly attached to a front surface of first portion 52. In other embodiments, primary portion 56 is flexibly attached to a rear surface of first portion 52 and secondary portion 58 is rigidly attached to a front surface of first portion 52. In still other embodiments, primary portion 56 and secondary portion 58 are each flexibly attached to first portion 52, such as with living hinges 60.

Second portion 54 is movable between an open configuration, as shown in FIG. 2A, and a closed configuration, as shown in FIG. 2B. In the open configuration, secondary portion 58 is flexed about living hinge 60 away from primary portion 56 to form an opening 62 into which electronic device 10 can be inserted into or removed from protective case 50. In the closed configuration, primary portion 56 and secondary portion 58 together encase at least a portion of electronic device 10 when the device 10 is received within case 50. In some embodiments, primary portion 56 and secondary portion 58 form a waterproof seal between the received electronic device 10 and an external environment. At least one of primary portion 56 and secondary portion 58 may include a gasket 64 to help provide a waterproof seal.

In some exemplary embodiments, at least a portion of first portion 52 is formed of a resilient flexible material, such that protective case 50 can be deformed to allow entry or removal of electronic device 10 when secondary portion 58 is in the open position.

In some exemplary embodiments, the primary portion 56 includes clasping mechanisms configured to selectively engage with corresponding clasping mechanisms on the secondary portion 58 to secure the case in the closed configuration. Exemplary clasping mechanisms are disclosed in U.S. Pat. No. 8,342,325, the disclosure of which are hereby incorporated by reference in its entirety.

As illustrated in FIG. 2A, the protective case 50 has an overall height indicated by $d_1$. The second portion 54 is movable about a flexible hinge 60 positioned at a distance from the closest edge of case 50 at a distance indicated by $d_2$. In some exemplary embodiments, the relative position of flexible hinge 60, as indicated by the ratio $d_2/d_1$ is as great as about 75%, about 70%, about 65%, about 60%, about 55%, about 50%, about 45%, about 40%, about 35%, as little as about 33%, about 30%, about 25%, about 20%, or less, or within any range defined between any two of the foregoing values, such as 20% to 75%, 20% to 50%, or 25% to 35%.

In some exemplary embodiments, protective case 50 provides protection from water by providing a waterproof seal around opening 62. In a typical waterproof case, a waterproof seal must be provided around an entire circumference of the case. However, as illustrated in FIGS. 2A and 2B, only the portion of protective case along primary portion 76 and secondary portion 78 needs to provide a waterproof enclosure for device 10. Accordingly, the length of the waterproof seal may be reduced compared to a typical waterproof case. In some exemplary embodiments, the gap sealed by a waterproof seal around opening 62 extends around as much as 75%, 70%, 60%, as little as 50%, 40%, 30%, or 25%, or less, of the total perimeter of protective case 50, or within any range defined between any two of the foregoing values, such as 25% to 75% or 50% to 75%. Advantageously, a shorter waterproof seal may provide fewer potential failure locations than a longer waterproof seal.

Figure 3A:
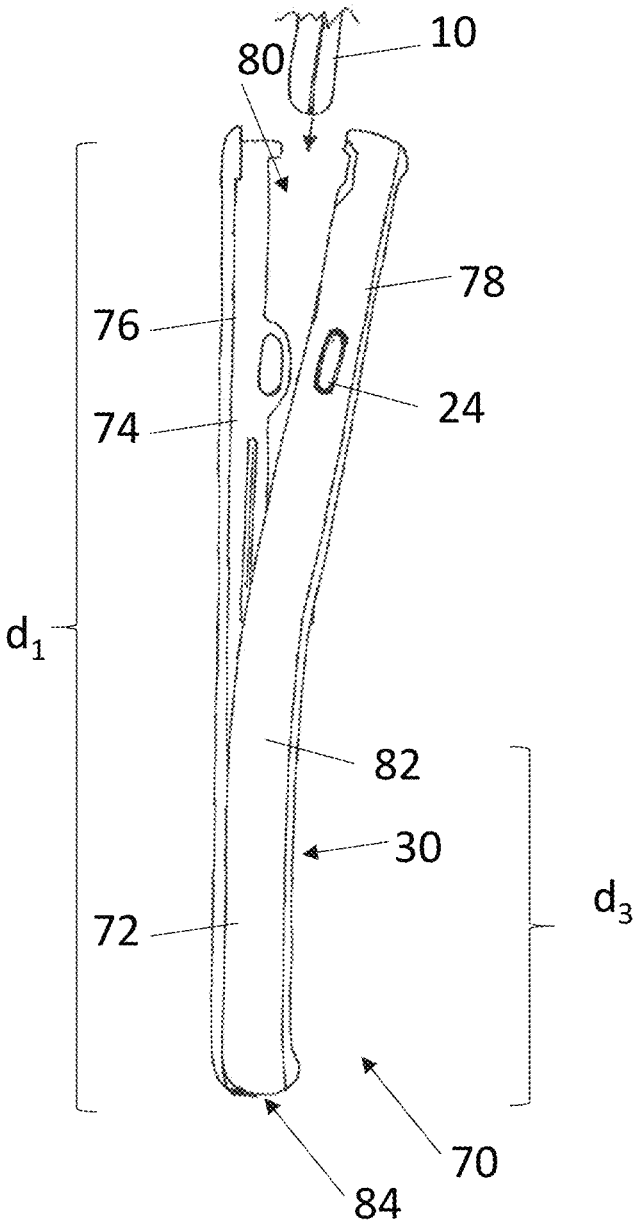
FIG. 3A illustrates inserting an electronic device into an exemplary protective case in an open configuration.
Figure 3B:
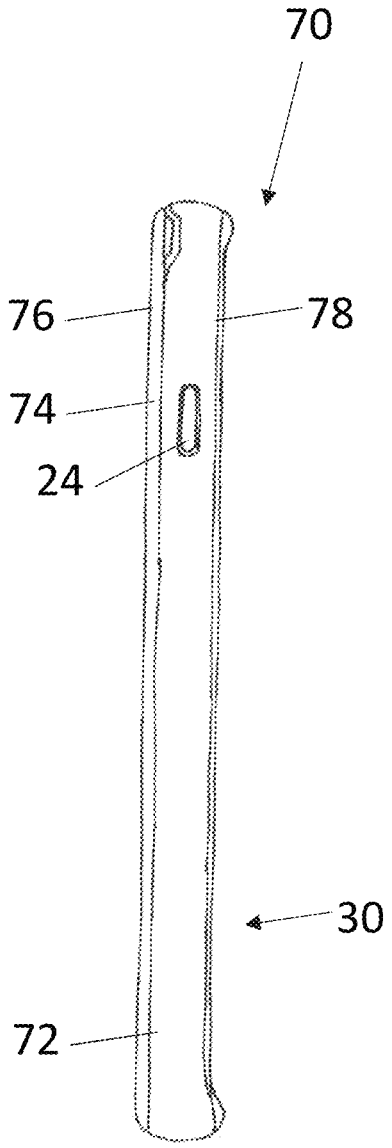
FIG. 3B illustrates the protective case of FIG. 3A in a closed configuration.

Referring next to FIGS. 3A and 3B, a protective case 70 for protecting electronic device 10 is illustrated. In some embodiments, protective case 20 (FIG. 1) is protective case 70.

Protective case 70 includes a first portion 72 and a second portion 74. Although illustrated in FIG. 3A with the first portion 72 as a bottom portion of case 70 and the second portion 74 as a top portion of case 70, in other embodiments first portion 72 comprises a top portion or side portion of case 70 and second portion 74 comprises a bottom portion or side opposing portion of case 70.

First portion 72 illustratively encases at least a portion of electronic device 10 when electronic device 10 is received within case 70, such as at least a portion of the bottom of electronic device 10. In some embodiments, first portion 72 provides a waterproof barrier between the received electronic device 10 and an external environment.

Second portion 74 is movable between an open configuration, as shown in FIG. 3A, and a closed configuration, as shown in FIG. 3B.

Second portion 74 illustratively encases at least a portion of electronic device 10 when electronic device 10 is received within case 70, such as at least a portion of the top of electronic device 10. Second portion 74 includes a primary portion 76 and secondary portion 78. Primary portion 76 illustratively covers at least a portion of electronic device 10 when electronic device 10 is received within case 78, such as at least a portion of the top back surface of electronic device 10. Secondary portion 78 illustratively covers at least a portion of electronic device 10 when electronic device 10 is received within case 78, such as at least a portion of the top front surface of electronic device 10.

One or more of primary portion 76 and secondary portion 78 is formed from a resilient flexible material configured to deform, thereby creating an opening 80 to allow entry or removal of electronic device 10 when second portion 74 is in the open position. In the illustrated embodiment, secondary portion 78 is formed from a resilient flexible material, thereby allowing secondary portion 78 to deform outwardly from primary portion 76 above a transition point 82 positioned between first portion 72 and second portion 74, thereby creating opening 80. In other embodiments, primary portion 76 is formed from a resilient flexible material, thereby allowing primary portion 76 to deform outwardly from secondary portion 78 above a transition point 82 between first portion 72 and second portion 74, thereby creating opening 80. In still other embodiments, primary portion 76 and secondary portion 78 are each formed from a resilient flexible material, thereby allowing primary portion 76 and secondary portion 78 to deform outwardly from each other above a transition point 82 between first portion 72 and second portion 74, thereby creating opening 80.

As illustrated in FIG. 3A, transition point 82 is positioned where first portion 72 meets second portion 74. Above transition point 82, second portion 74 includes primary portion 76 and secondary portion 78 formed from separate pieces that can be flexed open to allow electronic device 10 to be inserted into opening 80. Below transition point 82, first portion 72 does not include separate pieces that can be flexed open. In some exemplary embodiments, the pieces comprising primary portion 76 and secondary portion 78 are permanently fused together below transition point 82 to form first portion 72. In other embodiments, first portion 72 includes a single piece of material that is affixed to primary portion 76 and secondary portion 78 at transition point 82 to allow primary portion 76 and secondary portion 78 to flex between the open position illustrated in FIG. 3A and the closed position illustrated in FIG. 3B.

In some embodiments, forming the first portion 72 from a single piece of material or two permanently fused portions 76, 78, provides increased strength and/or durability to the portion of frame member 22 proximate aperture 26 for the charge port 16 of electronic device 10 (see FIG. 1).

In some embodiments, primary portion 76 and secondary portion 78 form a waterproof seal between the received electronic device 10 and an external environment. At least one of primary portion 76 and secondary portion 78 may include a gasket (not shown in FIGS. 3A and 3B) to help provide a waterproof seal.

In some exemplary embodiments, the primary portion 76 includes clasping mechanisms configured to selectively engage with corresponding clasping mechanisms on the secondary portion 78 to secure the case in the closed configuration.

As illustrated in FIG. 3A, the protective case 70 has an overall height indicated by $d_1$. The transition point 82 between the first portion 72 and second portion 74 where the primary portion 76 and secondary portion 78 begin is positioned at a distance from the closest edge of case 70 at a distance indicated by $d_3$. In some exemplary embodiments, the relative position of flexible hinge 60, as indicated by the ratio $d_3/d_1$ is as great as about 75%, about 70%, about 65%, about 60%, about 55%, about 50%, about 45%, about 40%, about 35%, as little as about 33%, about 30%, about 25%, about 20%, or less, or within any range defined between any two of the foregoing values, such as 20% to 75%, 20% to 50%, or 25% to 35%.

In some exemplary embodiments, protective case 70 provides protection from water by providing a waterproof seal around opening 80. In a typical waterproof case, a waterproof seal must be provided around an entire circumference of the case. However, as illustrated in FIGS. 3A and 3B, only the portion of protective case 70 along primary portion 76 and secondary portion 78 needs to provide a waterproof enclosure for device 10. Accordingly, the length of the waterproof seal may be reduced compared to a typical waterproof case. In some exemplary embodiments, the gap sealed by a waterproof seal around opening 80 extends around as much as 75%, 70%, 60%, as little as 50%, 40%, 30%, or 25%, or less, of the total perimeter of protective case 70, or within any range defined between any two of the foregoing values, such as 25% to 75% or 50% to 75%. Advantageously, a shorter waterproof seal may provide fewer potential failure locations than a longer waterproof seal.

Figure 4A:
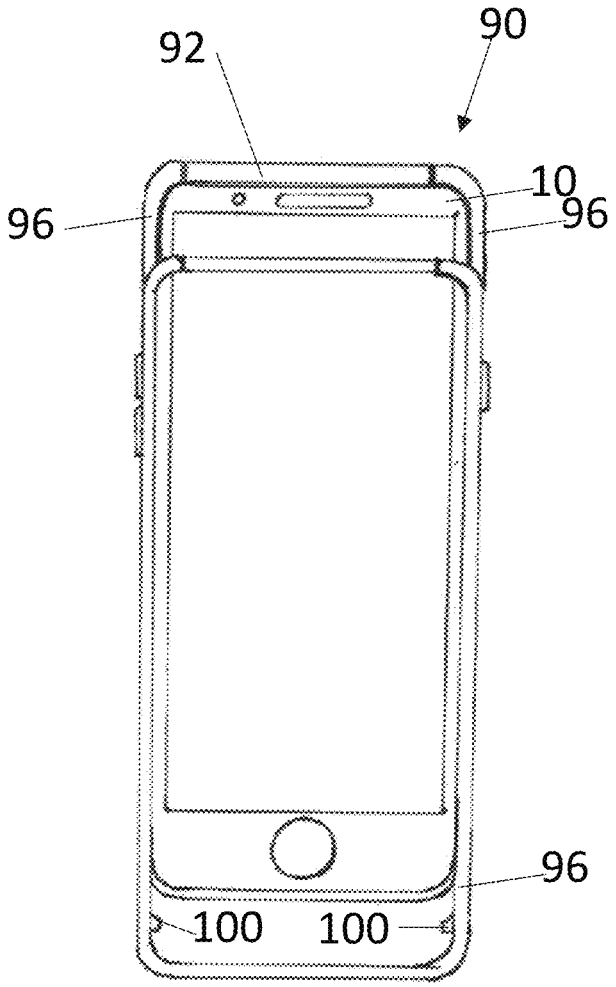
FIG. 4A illustrates a front view of an exemplary protective case in an open configuration.
Figure 4B:
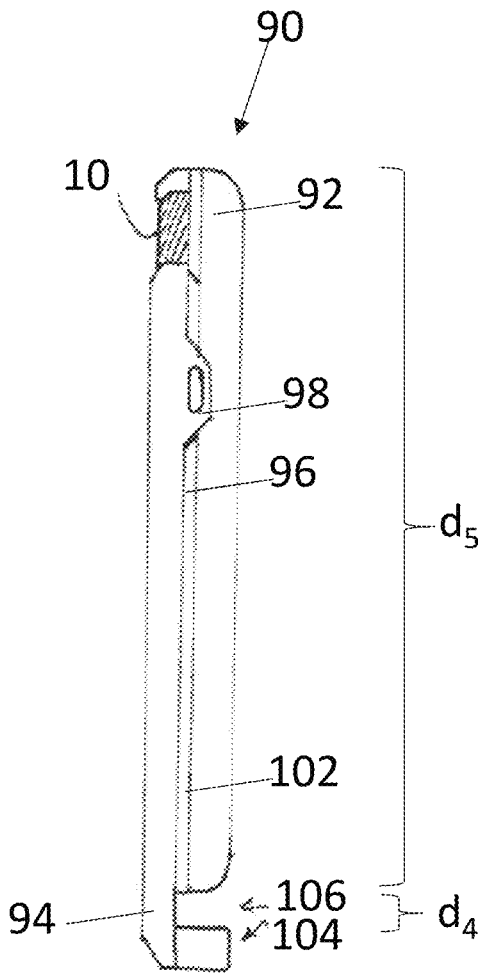
FIG. 4B illustrates a side view of the protective case of FIG. 4A in the open configuration.

Referring next to FIGS. 4A and 4B, a protective case 90 for protecting electronic device 10 is illustrated. In some embodiments, protective case 20 (FIG. 1) is protective case 90. FIGS. 4A and 4B illustrate protective case 90 in an open configuration.

Protective case 90 includes a first portion 92 at least partially covering a rear surface of electronic device 10 and a second portion 94 at least partially covering a front surface of electronic device 10. First portion 92 illustratively includes one or more grooves 96 into which corresponding projections 98 of second portion 94 are inserted. In other embodiments, second portion 94 includes grooves 96 and first portion 92 includes the corresponding projection 98.

Second portion 94 slides in one or more grooves 96 relative to first portion 92 between a closed configuration, such as illustrated in FIG. 1 and an open configuration as illustrated in FIGS. 4A and 4B. In the open configuration, an opening 106 is formed between the first portion 92 and the second portion 94 into which the electronic device 10 can be placed into or removed from protective case 90.

Protective case 90 includes one or more locking projections 100 configured to be releasably received in corresponding detents 102 to hold protective case 90 in the closed configuration. Grooves 96 may include one or more stops (not shown) to provide a maximum open configuration beyond which projections 98 are unable to travel in grooves 96. In some exemplary embodiments, the opening 106 has a length $d_4$ in the maximum open configuration as great as 75%, 70%, 65%, 60%, as little as 55%, 50%, 45%, 40%, compared to the length $d_5$ of the first portion 92, or between any two of the foregoing values, such as 40% to 75% or 45% to 60%.

In some embodiments, second portion 94 includes end member 104 at a bottom end of second portion 94. End member 104 is formed from a resilient flexible material, such as thermoplastic polyurethane (TPU). End member 104 serves to provide a bottom end to protective case 90, maintaining electronic device 10 in protective case 90 in the closed configuration. During installation or removal of electronic device 10 in protective case 90, end member 104 is deformed to allow electronic device 10 to be slid in or slid out of protective case 90.

In another exemplary embodiment, once the protective case 90 is in the open position, the first portion 92 can be flexed relative to the second portion 94 to allow electronic device 10 to be slid in or slid out of protective case 90. In a more particular embodiment, the projections 98 are configured to flex within grooves 96 to allow first portion 92 to flex relative to second portion 94 enough to allow electronic device 10 to be received within opening 106 of protective case 90.

Figure 5A:
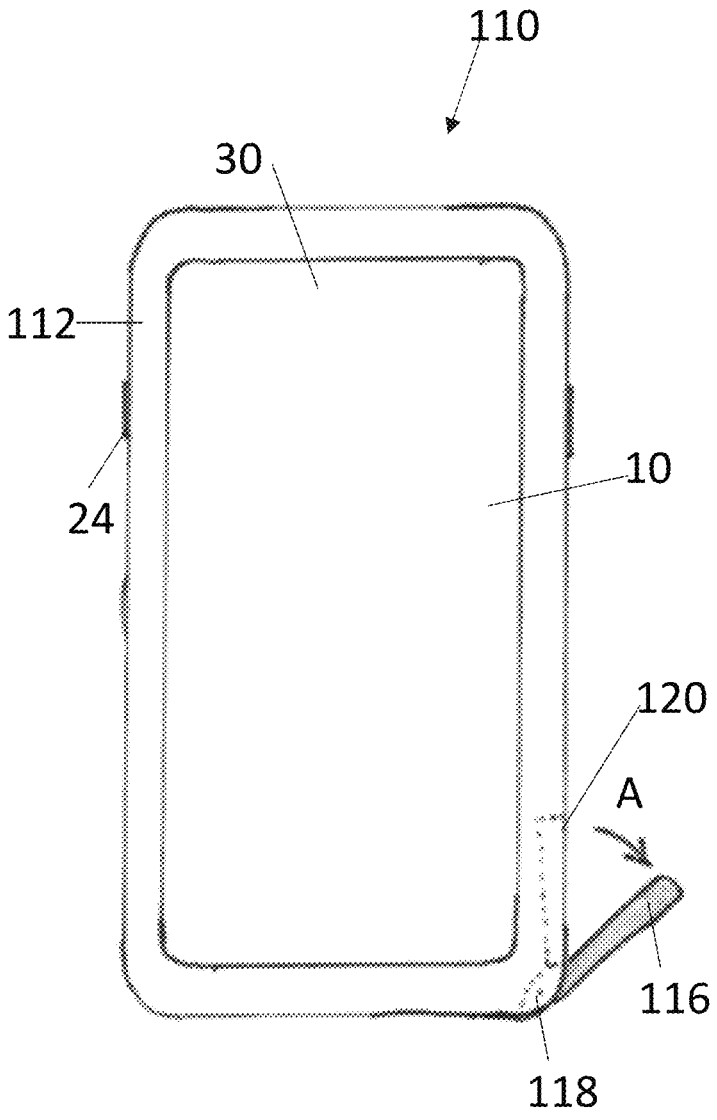
FIG. 5A illustrates a front view of an exemplary protective case including a rotatable opening mechanism.
Figure 5B:
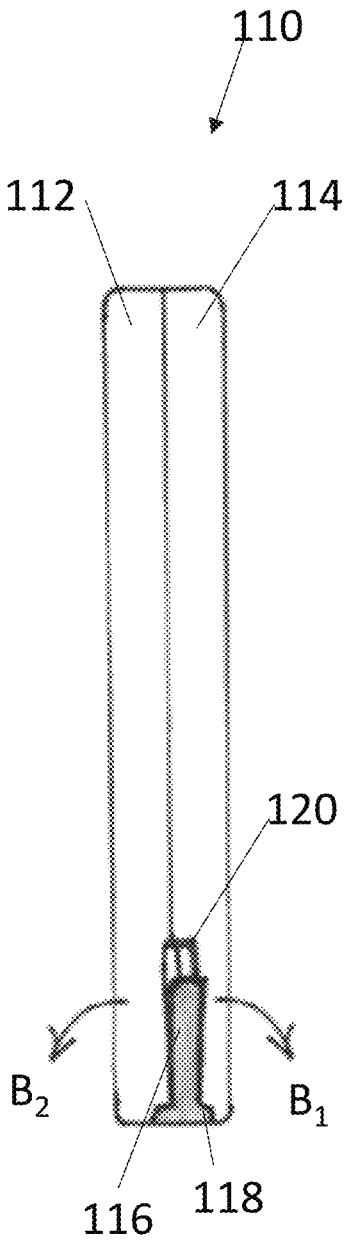
FIG. 5B illustrates a side view of the protective case of FIG. 5A.

Referring next to FIGS. 5A and 5B, a protective case 110 for protecting electronic device 10 is illustrated. In some embodiments, protective case 20 (FIG. 1) is protective case 110.

Protective case 110 includes a first portion 112 covering at least a portion of a front surface of electronic device 10 and a second portion 114 covering at least a back surface of electronic device 10.

First portion 112 and second portion 114 are releasably secured together with one or more clasping mechanisms. In some exemplary embodiments, first portion 112 includes clasping mechanisms configured to selectively engage with corresponding clasping mechanisms on second portion 114 to secure the case in the closed configuration.

Case 110 further includes a case key 116 rotatably attached by connection 118 to one of the first portion 112 and the second portion 114. Case key 116 is illustratively attached to first portion 112 or second portion 114 by a cam tether. Case key 116 is rotatable between a first position, in which case key 116 is positioned within recess 120 and a second position, as illustrated in FIGS. 5A and 5B.

To open protective case 110, such as to place electronic device 10 into or remove electronic device 10 from protective case, case key 116 is rotated about connection 118 from the first position within recess 120 to the second position, as shown by arrow A in FIG. 5A. Case key 116 is then twisted about the connection 118 as shown by arrow $B_1$ or $B_2$ in FIG. 5B to disengage clasping mechanisms in first portion 112 from corresponding clasping mechanisms in second portion 114 in a region of protective case 110 proximate case key 116 to form a gap.

A user can then expand this gap with additional twisting of case key 116 as shown by arrows $B_1$ and $B_2$, or can pull first portion 112 away from second portion 114 to separate first portion 112 and second portion, exposing the interior of protective case 110 and allowing electronic device 10 to be placed into or removed from the interior.

Although case key 116 is illustrated on a side of protective case 120 in FIGS. 5A and 5B, in other embodiments case key 116 is provided on a top or bottom side of protective case 110.

Advantageously, integrated case key 116 is connected to protective case 110, and therefore cannot be easily lost or misplaced by a user. Moreover, case key 116 can be stored in recess 120 such that it does not interfere with the use of the protective case 110 and electronic device 10.

Figure 6A:
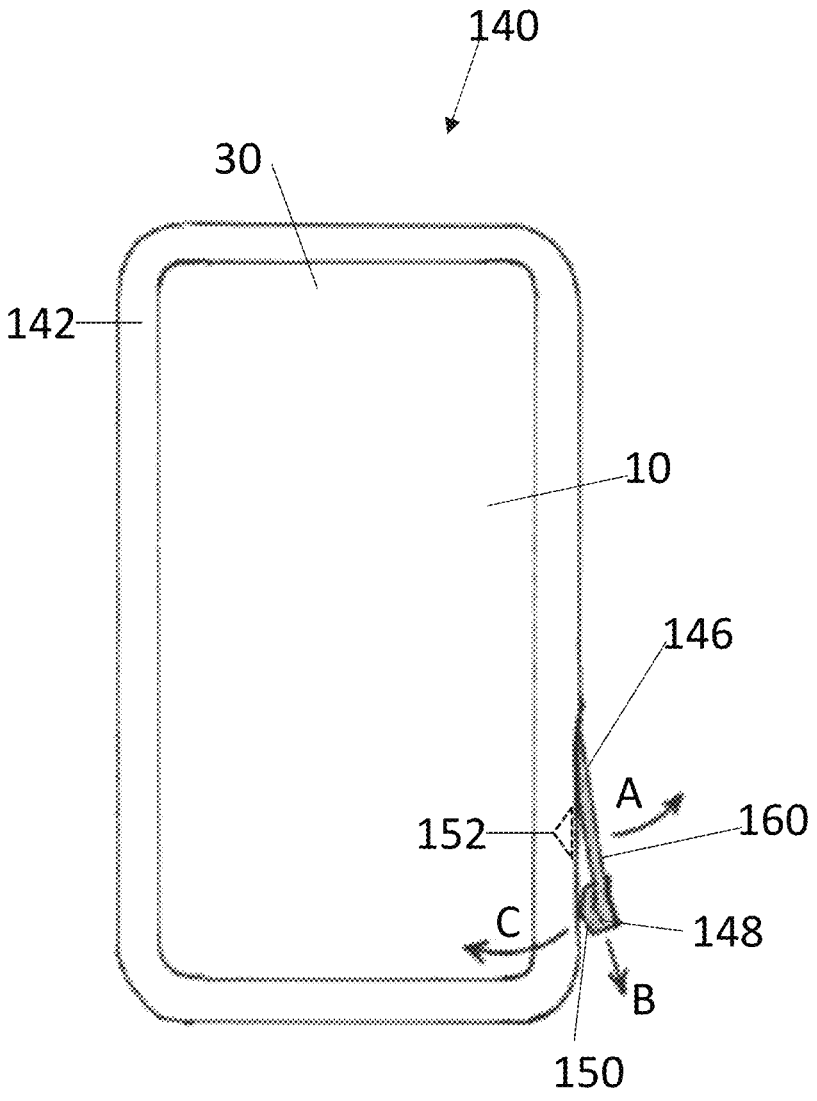
FIG. 6A illustrates a front view of an exemplary case including a slidable opening mechanism.
Figure 6B:
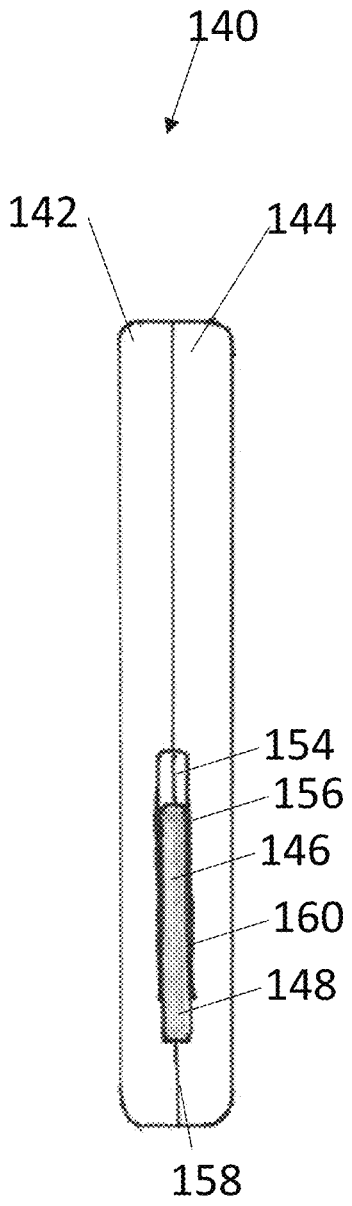
FIG. 6B illustrates a side view of the protective case of FIG. 6A.

Referring next to FIGS. 6A and 6B, a protective case 140 for protecting electronic device 10 is illustrated. In some embodiments, protective case 20 (FIG. 1) is protective case 140.

Protective case 140 includes a first portion 142 covering at least a portion of a front surface of electronic device 10 and a second portion 144 covering at least a back surface of electronic device 10.

First portion 142 and second portion 144 are releasably secured together with one or more clasping mechanisms. In some exemplary embodiments, first portion 142 includes clasping mechanisms configured to selectively engage with corresponding clasping mechanisms on second portion 144 to secure the case in the closed configuration.

Case 140 further includes a case key 146 attached to one of the first portion 142 and the second portion 144. Case key 146 includes a wedge 148 at the distal end. Wedge 148 is configured to be wedged into a corresponding slot 150 in protective case 140 to separate first portion 142 and second portion 144 to open protective case.

Case key 146 is movable between a first position and a second position. In the first position, the stem 160 is stored within recess 154 and wedge 148 is stored within recess 152 (position shown in dashed lines in FIG. 6A). In the second position, as shown in FIGS. 6A and 6B, the wedge 148 is aligned with the slot 150 to open protective case 140.

To open protective case 140, such as to place electronic device 10 into or remove electronic device 10 from protective case, case key 146 is moved from the first position to the second position by rotating the stem 160 and wedge 148 about base 156 as shown by arrow A in FIG. 6A. The base 156 is then slid through recess 154 as shown by arrow B in FIG. 6A. Although arrow B illustrates a movement toward the bottom of case 140, in other embodiments base 156 is slid in a direction toward the top of case 140. In other embodiments, case key 146 is provided on a top or bottom side of protective case 140. In some embodiments, the movement as shown by arrow A and arrow B are combined into a single movement. In some embodiments, base 156 is wider than the gap in recess 154, allowing base 156 to rotate and slide within recess 154, such as shown by arrows A and B in FIG. 6A.

The case key 146 is positioned such that the wedge 148 is aligned with the slot 148. In some embodiments, slot 148 is a beveled keyhole slot positioned on part line 158 between first portion 142 and second portion 144. In some exemplary embodiments, slot 148 does not extend through case 140 into an interior of protective case 140. The wedge 148 is then pushed into slot 148 as shown by arrow C in FIG. 6A, pushing apart first portion 142 and second portion 142 to disengage clasping mechanisms in first portion 142 from corresponding clasping mechanisms in second portion 144 in a region of protective case 140 proximate case key 146 to form a gap.

A user can then expand this gap with additional pressing of case key 146 into slot 150 as shown by arrow C, or can pull first portion 142 away from second portion 144 to separate first portion 142 and second portion 144, exposing the interior of protective case 140 and allowing electronic device 10 to be placed into or removed from the interior.

Advantageously, integrated case key 146 is connected to protective case 140, and therefore cannot be easily lost or misplaced by a user. Moreover, case key 146 can be stored when not in use such that it does not interfere with the use of the protective case 110 and electronic device 10.

Figure 7:
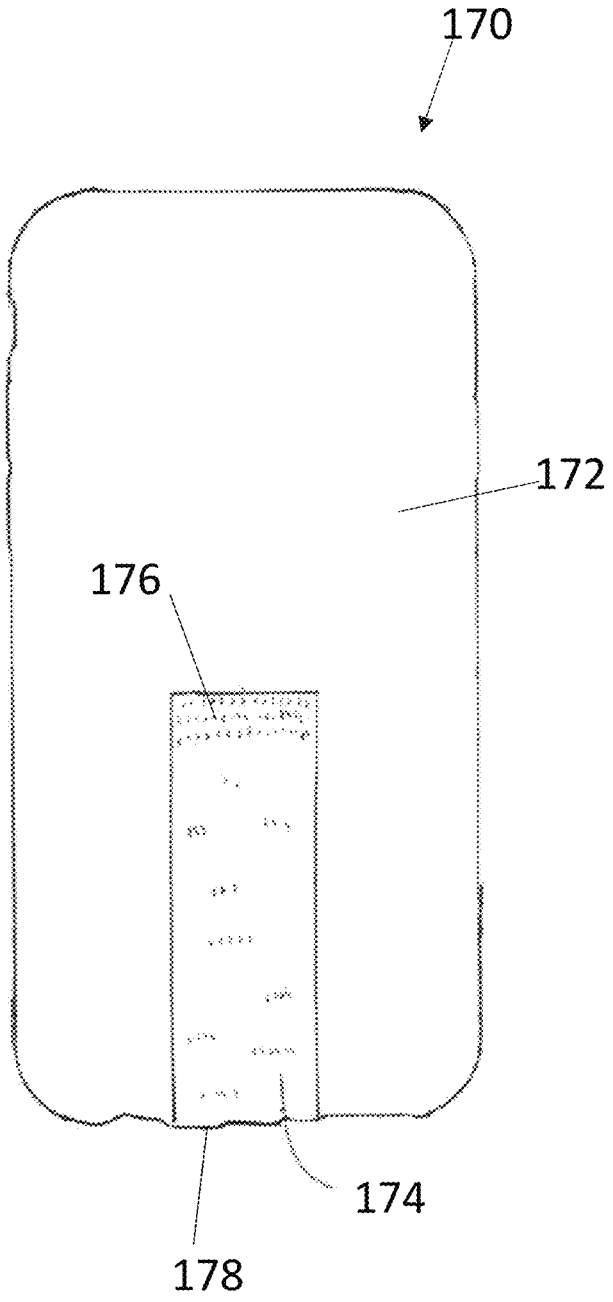
FIG. 7 illustrates a back view of an exemplary protective case.

Referring next to FIG. 7, a rear view of a protective case 170 for protecting electronic device 10 is illustrated. In some embodiments, protective case 20 (FIG. 1) is protective case 170. Exemplary protective cases are also disclosed in U.S. Pat. Nos. 9,295,174 and 9,774,713, the disclosures of which are hereby incorporated by reference in their entirety. Protective case 170 includes a rear surface 172 at least partially covering a rear surface of the encased electronic device. Rear surface 172 includes an attachment region 176.

Attachment region 176 illustratively includes a plurality of hooks 176 molded into the rear surface 172 of protective case 170. In some exemplary embodiments, rear surface 172 is formed from a thermoplastic material and the plurality of hooks 176 are formed from injection molding the thermoplastic material into a mold, resulting in the plurality of hooks 176 being integrally formed with the rear surface 172 of protective case 170. The plurality of hooks 46 are configured to releasably attach protective case 170 to corresponding loops on an accessory module (not shown), such as a mounting module for a bicycle, armband, or dashboard.

In the exemplary embodiment illustrated in FIG. 7, attachment region 174 is at least partially bounded by an edge 178 of the rear surface 172. In other embodiments, attachment region 174 is not bounded by an edge 178 and is surrounded by rear surface 172.

In some exemplary embodiments, attachment region 176 is flush with the rear surface 172. In other exemplary embodiments, attachment region 176 is recessed with respect to rear surface 172.

Although illustratively formed as a part of rear surface 172 in FIG. 7, in other embodiments the plurality of hooks 176 of attachment region 174 may be formed on a front and/or side surface of protective case 170. In some embodiments, the plurality of hooks 176 are formed on two or more of a front surface, the rear surface 172 and one or more side surfaces of protective case 170.

Figure 8A:
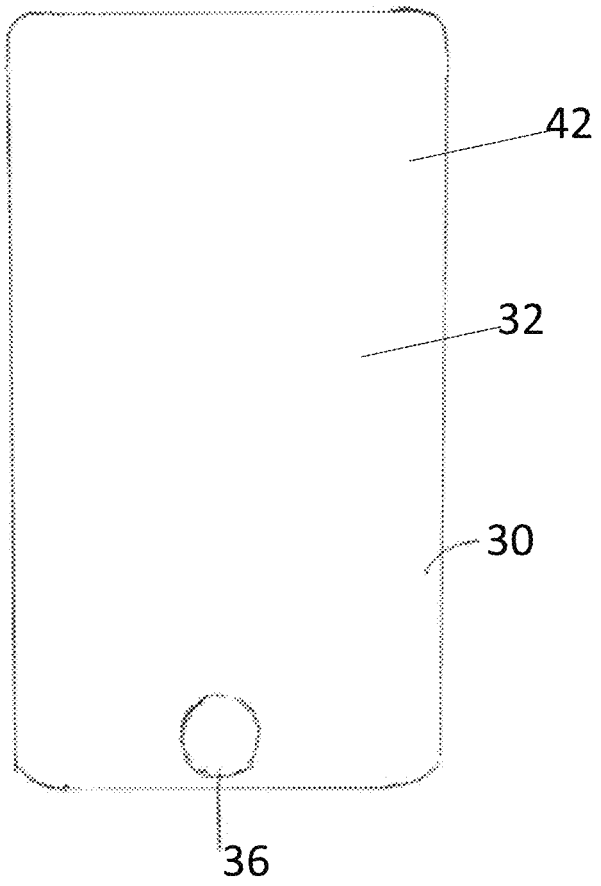
FIG. 8A illustrates a front view of an exemplary screen protector for protecting a front surface of an electronic device.
Figure 8B:
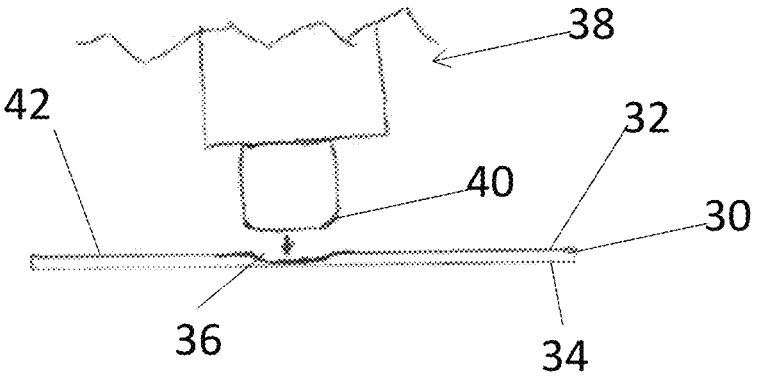
FIG. 8B illustrates an exemplary tool for forming the screen protector of FIG. 8A.

Referring next to FIGS. 8A and 8B, an exemplary screen protector 30 for a protective case is illustrated. In some embodiments, screen protector 30 is a thermoplastic membrane screen protector 30 for protective case 20 (FIG. 1). Other protective cases including membranes are disclosed in U.S. Pat. No. 8,342,325, the disclosure of which is hereby incorporated by reference in its entirety.

Screen protector 30 is configured to overlay and protect at least a portion of a display 12 of an electronic device 10 (FIG. 1). In some embodiments, screen protector 30 comprises a flexible transparent polymeric material, such as polyethylene terephthalate (PET).

As shown in FIGS. 8A and 8B, screen protector 30 has a front surface 32 and a rear surface 34 opposite front surface 32. In some embodiments, screen protector 30 provides interactive access to a touch-screen interface of an electronic device in contact with rear surface 34 of screen protector 30.

Screen protector 30 includes reduced thickness area 36, the reduced thickness area 36 having a thickness less than the thickness of the main portion 42 screen protector 30. In some exemplary embodiments, reduced thickness area 36 is positioned to align with a button or fingerprint sensor of an electronic device in contact with rear surface 34 of screen protector 30. In some exemplary embodiments, reduced thickness area 36 has a thickness as little as 10%, 20%, 25%, 30%, 40%, as great as 50%, 60%, 70%, 75%, or 80% of the main portion 42 of screen protector 30, or within any range defined between any two of the foregoing values, such as 10% to 80% or 25% to 75%.

In some embodiments, reduced thickness area 36 has increased flexibility compared to membrane 30 to allow a user to actuate the button of the electronic device 10 through reduced thickness area 36. In some exemplary embodiments, reduced thickness area 36 allows a fingerprint sensor, such as an in-screen ultrasonic fingerprint sensor in a display 12 of an electronic device 10 in contact with rear surface 34 of screen protector 30 to read a user's fingerprint placed in contact with front surface 32.

As illustrated in FIGS. 8A and 8B, reduced thickness area 36 is integrally formed from screen protector 30. Reduced thickness area 36 is not a separate piece of material that is adhered to an aperture formed in screen protector 30

In one exemplary embodiment, reduced thickness area 36 is formed by stamping or coining screen protector 30 with an apparatus 38 such as a stamping or machining press. A die-head 40 of apparatus 38 impacts a selected area of screen protector 30 and thins the material to form reduced thickness area 36.

In another exemplary embodiment, reduced thickness area 36 is formed by chemically etching the material of screen protector 30, such as by acid or other suitable chemical. In another exemplary embodiment, reduced thickness area 36 is formed by laser engraving the material of screen protector 30. In another exemplary embodiment, reduced thickness area 36 is formed by mechanically treating the material of screen protector 30, such as by machining, grinding, or polishing the material of screen protector 30.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A protective case for an electronic device, the protective case comprising:

a first portion configured to receive a bottom portion of the electronic device;

a second portion attached to the first portion and configured to receive a top portion of the electronic device, the second portion including a primary portion and a secondary portion, the primary portion movable relative to the secondary portion between a closed configuration and an open configuration including an opening formed between the primary portion and the secondary portion for receiving the electronic device in the protective case; and a case key rotatably attached to one of the first portion and the second portion, the case key movable from a first position in which the case key is at least partially positioned within a recess of the protective case to a second position in which the case key is configured to release the secondary portion from the primary portion, wherein the case key remains directly and rotatably attached to the one of the first portion and the second portion in both the first position and the second position.

2. The protective case of claim 1, wherein the primary portion is configured to cover at least a portion of a back surface of the electronic device and the secondary portion is configured to cover at least a portion of the front surface of the electronic device when the electronic device is received in the protective case.

3. The protective case of claim 1, wherein the primary portion is attached to the secondary portion with a living hinge, the primary portion movable about the living hinge between the closed configuration and the open configuration.

4. The protective case of claim 3, wherein a ratio of the distance between the living hinge and a closer edge selected from a top edge and a bottom edge of the protective case to an overall height of the protective case is between 20% and 75%.

5. The protective case of claim 1, the protective case further comprising a transition point positioned between the first portion and the second portion, wherein the primary portion and the secondary portion are each formed from a resilient flexible material, the primary portion and the secondary portion each configured to resiliently flex away from each other about the transition point to form the opening.

6. The protective case of claim 5, wherein a ratio of the distance between the transition point and a closest edge of the protective case to an overall height of the protective case is between 20% and 75%.

7. The protective case of claim 1, wherein the primary portion includes a first clasping mechanism configured to selectively engage a second clasping mechanism of the secondary portion to secure the protective case in the closed configuration.

8. The protective case of claim 1, further comprising a gasket positioned between the primary portion and the secondary portion, the gasket forming a waterproof seal when the protective case is in the closed configuration.

9. The protective case of claim 1, wherein the case key includes a wedge at a distal end of the case key, wherein the wedge is configured to be wedged into a slot between the first portion and the second portion to release the first portion from the second portion.

10. A protective case for an electronic device, the protective case comprising:

a first portion configured to cover at least a portion of a rear of the electronic device when the electronic device is received within the protective case;

a second portion configured to cover at least a portion of the front of the electronic device when the electronic device is positioned within the protective case, the second portion including a plurality of clasping mechanisms configured to selectively engage with a corresponding plurality of clasping mechanisms on the first portion;

a recess formed in at least one of the first portion and the second portion; and a case key rotatably attached to one of the first portion and the second portion, the case key movable from a first position in which the case key is at least partially positioned within the recess to a second position in which the case key is configured to release at least some of the plurality of clasping mechanisms of the second portion from the corresponding clasping mechanisms of the first portion, wherein the case key remains directly and rotatably attached to the one of the first portion and the second portion in both the first position and the second position.

11. The protective case of claim 10, wherein the case key is configured to rotate and slide relative to the first portion and the second portion between the first position and the second position, and wherein the case key is configured to release at least some of the plurality of clasping mechanisms of the second portion from the corresponding clasping mechanisms of the first portion by inserting a wedge of the case key into a slot formed between the first portion and the second portion.

12. The protective case of claim 10, wherein a rear surface of the protective case includes a plurality of hooks integrally molded into the rear surface of the protective case, the plurality of hooks configured to releasably attach the protective case to corresponding loops of an accessory module.

13. The protective case of claim 10, wherein the second portion includes a screen protector configured to at least partially cover a display of the electronic device when the electronic device is received within the protective case, the screen protector including a reduced thickness area having a thickness less than a thickness of a remainder of the screen protector, the reduced thickness area configured to align with a button or a fingerprint sensor of the electronic device when the electronic device is received within the protective case.

* * * * *